US008774661B2

(12) United States Patent
Pines et al.

(10) Patent No.: US 8,774,661 B2
(45) Date of Patent: Jul. 8, 2014

(54) IMAGE FORMING SYSTEM AND METHODS THEREOF

(75) Inventors: Assaf Pines, Rehovot (IL); Nir Freund, Nes Ziona (IL); Oren Wilde, Rishon Le Zion (IL)

(73) Assignee: Hewlett-Packard Indigo, B.V., Amstelveen (NL)

( * ) Notice: Subject to any disclaimer, the term of this patent is extended or adjusted under 35 U.S.C. 154(b) by 330 days.

(21) Appl. No.: 13/285,497

(22) Filed: Oct. 31, 2011

(65) Prior Publication Data

US 2013/0108297 A1 May 2, 2013

(51) Int. Cl.
*G03G 15/10* (2006.01)

(52) U.S. Cl.
USPC ..... 399/57; 399/58

(58) Field of Classification Search
USPC ..... 399/57, 58
See application file for complete search history.

(56) References Cited

U.S. PATENT DOCUMENTS

| | | | | |
|---|---|---|---|---|
| 5,963,758 | A * | 10/1999 | Corn et al. | 399/57 |
| 6,687,477 | B2 * | 2/2004 | Ichida et al. | 399/57 |
| 7,694,642 | B2 | 4/2010 | DeVroome | |
| 2001/0008585 | A1 * | 7/2001 | Hagiwara | 399/57 |
| 2009/0220282 | A1 * | 9/2009 | Kato | 399/238 |
| 2012/0121282 | A1 * | 5/2012 | Oba et al. | 399/57 |

* cited by examiner

*Primary Examiner* — Ryan Walsh

(57) ABSTRACT

An image forming system includes a segregation tank to store a first imaging oil having a first percent purity, a reservoir to store a second imaging oil having a second percent purity, a slope identification module to identify a first slope value, and a slope comparison module to determine whether the first slope value is at least one of equal to, greater than, and less than a threshold slope value within a threshold slope range. The image forming system also includes a ratio adjustment module to obtain a variable ratio value corresponding to a ratio of a first amount of the first imaging oil to a second amount of the second imaging oil based on a determination by the slope comparison module.

20 Claims, 4 Drawing Sheets

IMAGE FORMING SYSTEM AND METHODS THEREOF

BACKGROUND

Image forming systems such a liquid electrophotography printing apparatus may include providing imaging oil to a fluid tank and a maintenance unit. The imaging oil may be mixed with ink concentrate in the fluid tank to form ink to be provided to a fluid applicator unit such as binary ink developers. The fluid applicator unit may provide the ink to a latent image on a photoconductive member to form fluid images. The photoconductive member may transfer the fluid images onto an image transfer member and/or substrate. The maintenance unit may use the imaging oil to perform a maintenance operation on the photoconductive member, for example, after the transfer of a respective fluid image there from.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
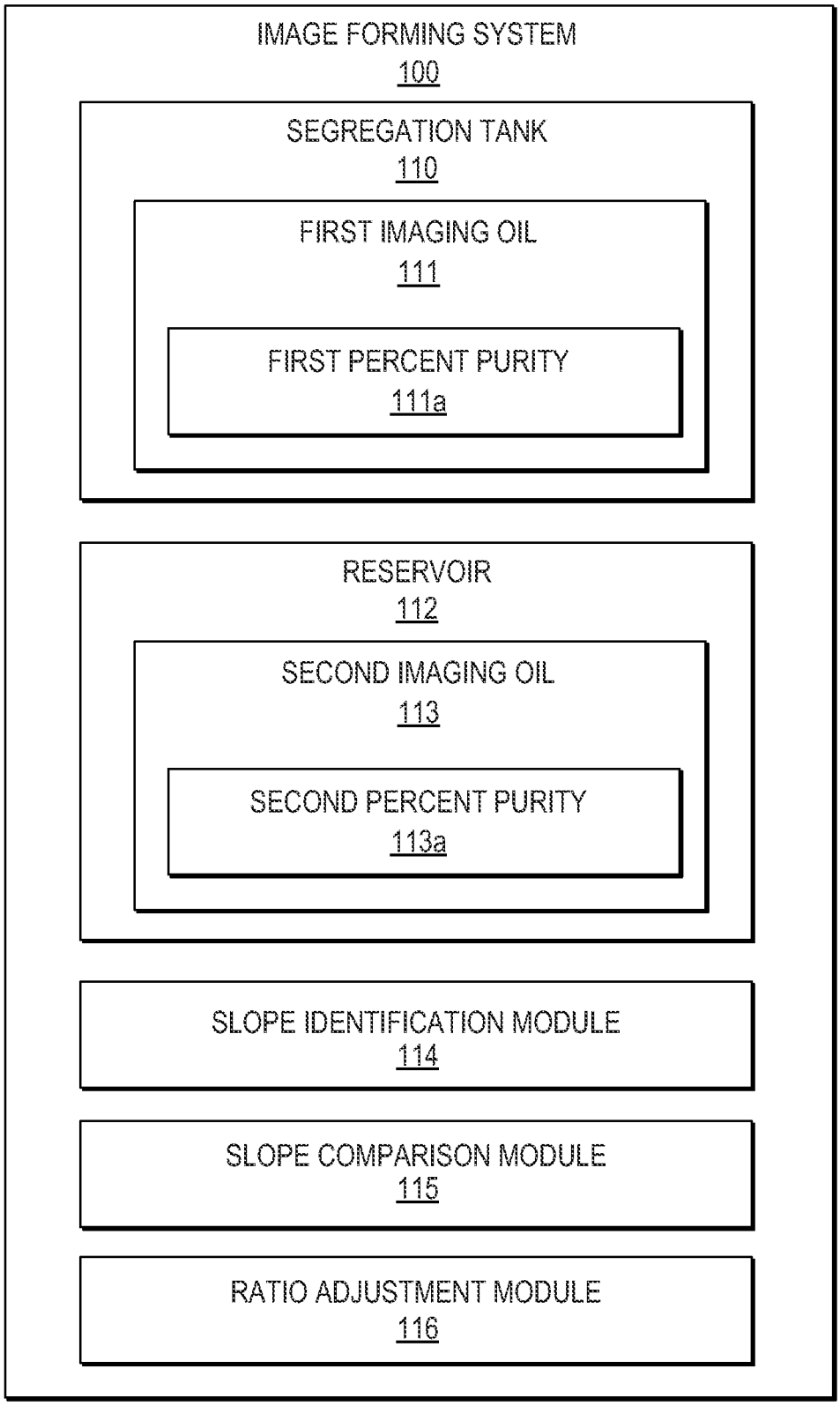
FIG. 1 is a block diagram illustrating an image forming system according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming systems such a liquid electrophotography printing apparatus may include providing imaging oil to a fluid tank and a maintenance unit. The imaging oil may be mixed with ink concentrate in the fluid tank to form ink to be provided to a fluid applicator unit such as binary ink developers (BIDs). The maintenance unit may use the imaging oil to perform a maintenance operation. Previously used imaging oils in the image forming system may be reused therein. For example, previously used imaging oil may be recycled within the image forming system to form a first imaging oil having a first percent purity corresponding to a clean imaging oil. Additionally, previously used imaging oil may be filtered within the image forming system to form a second imaging oil having a second percent purity corresponding to a less-clean imaging oil than the first imaging oil. Percent purity may refer to the percent of a specified compound or element (e.g. imaging oil) in an impure sample. In other words, the percentage of the imaging oil that is pure and/or free from unwanted matter. Such imaging oils may be mixed corresponding to a fixed ratio to form an imaging oil with an acceptable percent purity to form high quality images. The fixed ratio, however, may be independent of the current state of the amount of the first imaging oil (e.g., clean imaging oil) presently in the image forming system. Thus, the use of the previously used first imaging oil may not be maximized and the amount of replaceable imaging oil supply needed to be added to the image forming system may increase.

In examples, an image forming system includes, among other things, a first imaging oil having a first percent purity, a second imaging oil having a second percent purity, and a ratio adjustment module. Imaging oil previously used in the image forming system may be reused therein. For example, previously used imaging oil may be recycled within the image forming system to form a first imaging oil having a first percent purity corresponding to a clean imaging oil. Additionally, previously used imaging oil may be filtered within the image forming system to form a second imaging oil having a second percent purity corresponding to a less-clean imaging oil than the first imaging oil. The ratio adjustment module may obtain a variable ratio value corresponding to a ratio of a first amount of the first imaging oil to a second amount of the second imaging oil based on a determination by a slope comparison module. That is, the variable ratio value may be dependent on a current amount of the previously used first imaging oil in a segregation tank of the image forming system based on real-time conditions. Thus, the use of the previously used first imaging oil is increased and the amount of replaceable imaging oil supply needed to be added to the image forming system may be decreased. Consequently, imaging oil waste may be reduced while maintaining and/or increasing print quality.

FIG. 1 is a block diagram illustrating an image forming system according to an example. Referring to FIG. 1, in some examples, an image forming system 100 includes a segregation tank 110, a reservoir 112, a slope identification module 114, a slope comparison module 115, and a ratio adjustment module 116. The segregation tank 110 may store a first imaging oil 111 having a first percent purity 111*a*. The reservoir 112 may store a second imaging oil 113 having a second percent purity 113*a*. In some examples, the second percent purity 113*a* may be less than the first percent purity 111*a*. In some examples, the first and second imaging oil 111 and 113 may include low weight, liquid aliphatic hydrocarbons. For example, the imaging oil may be Isopar, trademarked by Exxon Corporation.

The slope identification module 114 may identify a first slope value corresponding to a first rate of flow of the first imaging oil 111 into the segregation tank 110 during a time interval minus a second rate of flow of the first imaging oil 111 out of the segregation tank 110 during the time interval. That is, in some examples, the slope identification module 114 may determine a net change in a total amount of the first imaging oil 111 in the segregation tank 110. The slope comparison module 115 may determine whether the first slope value is at least one of equal to, greater than, and less than a threshold slope value within a threshold slope range. For example, the threshold slope range may enable to the image forming system 100 to operate in a stable manner within a predetermine range. The ratio adjustment module 116 may obtain a variable ratio value corresponding to a ratio of a first amount of the first imaging oil 111 to a second amount of the second imaging oil 113 based on a determination by the slope comparison module 115.

Figure 2:
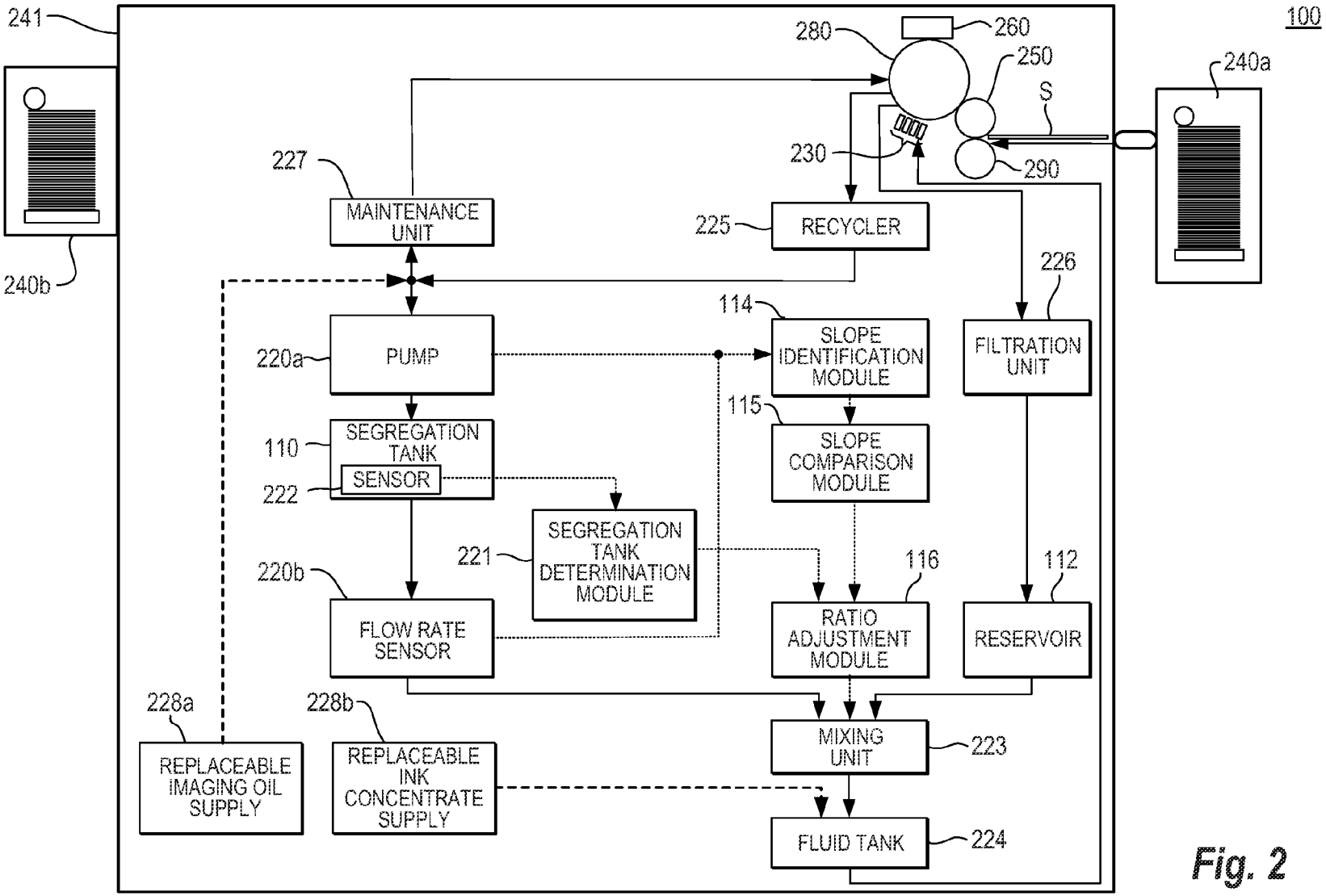
FIG. 2 is a schematic view illustrating the image forming system of FIG. 1 according to an example.

FIG. 2 is a schematic view illustrating the image forming system of FIG. 1 according to an example. In some examples, the image forming system 100 may be a liquid electrophotography printing apparatus (LEP apparatus), or the like. Referring to FIG. 2, in some examples, the image forming system 100 may include the segregation tank 110, the reservoir 112, the slope identification module 114, the slope comparison module 115, and the ratio adjustment module 116 as previously disclosed with respect to the image forming system 100 illustrated in FIG. 1. Referring to FIG. 2, the image forming system 100 may also include an imaging forming unit 241, an input unit 240*a*, and an output unit 240*b*. The image forming unit 241 may receive a substrate S such as a print media from an input unit 240*a* and output the substrate S to an output unit 240*b*. The imaging forming unit 241, for example, may include a recycler 225, a filtration unit 226, segregation tank determination module 221, a sensor 222, a mixing unit 223, a fluid tank 224, a maintenance unit 227, a pump 220*a*, a flow rate sensor 220*b*, a replaceable imaging oil supply 228*a*, a replaceable ink concentrate supply 228*b*, a photoconductive member 280, a laser writing unit 260, a fluid applicator unit 230, an intermediate transfer member (ITM) 250, and an impression member 290.

Referring to FIG. 2, in operation, the first imaging oil 111 (FIG. 1) is provided at a first rate of flow to the segregation tank 110, for example, through the pump 220*a* from the recycler 225. The recycler 225 recycles previously used imaging oil, for example, from the photoconductive member 280. The maintenance unit 227 selectively provides, for example, the first imaging oil 111 from the recycler 225 to the photoconductive member 280 to perform a maintenance operation thereon. Alternatively, the maintenance unit 227 may provide the first imaging oil 111 from the segregation tank 110 or the second imaging oil 113 from the reservoir 112 to perform the maintenance operation. The first imaging oil 111 is provided at a second rate of flow from the segregation tank 110 to the mixing unit 223, for example, through the flow rate sensor 220*b*. A second imaging oil 113 (FIG. 1) is provided to the reservoir 112, for example, from the filtration unit 226 that filters previously used imaging oil, for example, from the photoconductive member 280. The second imaging oil 113 is provided from the reservoir 112 to the mixing unit 223.

Additionally, in operation, the slope identification module 114 communicates with the pump 220*a* and the flow rate sensor 220*b* to obtain data, for example, to correspond to a net change of the first imaging oil 111 in the segregation tank 110 to provide to the slope comparison module 115. Alternatively, the net change of the slope may be determined by obtaining the difference between the previous level of first imaging oil 112 in the segregation tank 110 obtained at the last interval and the current level of first imaging oil 112 in the segregation tank 110 divided by the interval. The respective levels of first imaging oil 112 in the segregation tank 110 may be measured by a sensor 222 such as a level sensor and/or quantity sensor. The slope comparison module 115 may determine whether a first slope value is at least one of equal to, greater than, and less than a threshold slope value within a threshold slope range and communicate such data to the ratio adjustment module 116. Further, the segregation tank determination unit 221 communicates with the sensor 222 to obtain data, for example, to correspond to whether the segregation tank 110 is full of the first imaging oil 111 and provide such data to the ratio adjustment module 116. Still yet, the mixing unit 223 provides at least one of the first imaging oil 111 and the second imaging oil 113 corresponding to the variable ratio value obtained by the ratio adjustment module 116 to replenish depleted imaging oil and form a high quality ink such as liquid toner in the fluid tank 224. The replaceable ink concentrate supply 228*b* provides ink concentrate, or the like, to the fluid tank 224, as needed. Further, the replaceable imaging oil supply 228*a* may supply the first imaging oil 111 to the segregation tank 110, as needed.

Referring to FIG. 2, in operation, the fluid from the fluid tank 224 is provided to the fluid application unit 230 such as a respective BID to selectively form a liquid image on the photoconductive member 280. That is, the laser writing unit 260 selectively forms an electrostatic and/or latent image on the photoconductive member 280 to receive the fluid from the fluid application unit 230 to form the liquid image thereon. The photoconductive member 280 transfers the respective fluid image to the ITM 250. The ITM 250 and the impression member 290 pinch the substrate S there between. The ITM 250 transfers the fluid image to the respective substrate S. Subsequently, the substrate S is transported to the output unit 240*b*.

Referring to FIG. 2, in some examples, the segregation tank determination module 221 may determine whether a total amount of the first imaging oil 111 in the segregation tank 110 is at least one of equal to and greater than a threshold amount value during a time interval to obtain one of a first determination and a second determination. The time interval may correspond to a predetermined frequency at which the segregation tank determination module 221 continually makes the respective determinations. The first determination may correspond to the total amount of the first imaging oil 111 in the segregation tank 110 that is at least one of equal to and greater than the threshold amount value during the time interval. Additionally, the second determination may correspond to the total amount of the first imaging oil 111 in the segregation tank 110 that is less than the threshold amount value during the time interval. For example, the sensor 222 may be disposed in the segregation tank 110 to detect when a level of the first imaging oil 111 corresponds to the threshold amount value. The level may correspond to the total amount of the first imaging oil 111 in the segregation tank 110. Thus, the sensor 222 may detect when the segregation tank 110 is full of the first imaging oil 111.

The ratio adjustment module 116 may obtain the variable ratio value by decreasing a previous variable ratio value in response to the first determination obtained by the segregation tank determination module 221. For example, the first determination may correspond to the total amount of the first imaging oil 111 in the segregation tank 110 that is at least one of equal to and greater than the threshold amount value during the time interval. That is, the segregation tank 110 may currently have a great amount and/or full supply of first imaging oil. The slope identification module 114 may identify a second slope value in response to the second determination obtained by the segregation tank determination module 221. The second slope value may correspond to the first rate of flow of the first imaging oil 11 into the segregation tank 10 during the time interval minus the second rate of flow of the first imaging oil 111 out of the segregation tank 110 during the time interval. That is, the second slope value may be identified similar to the identification of the first slope value, but at a later time. For example, the second slope value may be identified at a subsequent time interval in which the first rate and second rate of flow of the first imaging oil 111 with respect to the segregation tank 110 may have changed.

The slope comparison module 115 may determine whether the second slope value is at least one of equal to, greater than, and less than the threshold slope value within the threshold slope range in response to the second determination obtained by the segregation tank determination module 221. The ratio adjustment module 116 may obtain the variable ratio value based on the determination by the slope comparison module 115 in response to the second determination obtained by the segregation tank determination module 221. For example, the second determination may correspond to the total amount of the first imaging oil 11 in the segregation tank 110 being less than the threshold amount value during the time interval. That is, the segregation tank 10 may not currently have a full supply of the first imaging oil 111.

Referring to FIG. 2, in some examples, the ratio adjustment module 116 may decrease a previous variable ratio value in response to the second determination obtained by the segregation tank determination module 221 and a determination that the second slope value is greater than the threshold slope value within the threshold slope range by the slope comparison module 115. Alternatively, the ratio adjustment module 116 may increase the previous variable ratio value in response to the second determination obtained by the segregation tank determination module 221 and a determination that the second slope value is less than the threshold slope value within the threshold slope range by the slope comparison module 115.

Still yet, the variable ratio value may remain the same as the previous variable ratio value in response to the second determination obtained by the segregation tank determination module 221 and a determination that the second slope value is equal to the threshold slope value within the threshold slope range by the slope comparison module 115. The mixing unit 223 may add at least one of the first imaging oil 111 from the segregation tank 110 and the second imaging oil 113 from the reservoir 112 to the fluid tank 224 corresponding to the respective variable ratio value based on a determination by the ratio comparison unit 116 and in response to a decrease in an amount of at least one of the first imaging oil 111 and the second imaging oil 113 in the fluid tank 224. The decrease in the respective amount of imaging oil 111 and 113 may be due to printing demands of the image forming system 100 including an amount of printing and the type of images printed.

Referring to FIG. 2, the recycler 225 may recycle imaging oil 111 and 113 previously used in the image forming system 100 to form a first imaging oil 111 having a first percent purity 111*a*. For example, the recycler 225 may include a condenser, vapor collector, evaporator, and/or heat pump, or the like. The filtration unit 226 may filter imaging oil 111 and 113 previously used in the image forming system 100 to form a second imaging oil 113 having a second percent purity 113*a*. For example, the filtration unit 226 may include a mesh filter, silicon crystals, activated carbon, or the like. The previously used imaging oil 111 and 113, for example, may be imaging oil used in a maintenance operation, residue from an image forming operation, or the like. The residue may include imaging oil having other particles remaining on the photoconductive member 280, intermediate transfer member 250, or the like, after an image transfer operation. The maintenance operation may include the use of imaging oil 111 to clean the photoconductive member 280, intermediate transfer member 250, or the like.

The pump 220*a* may transport a first imaging oil 111 from the recycler 225 to the segregation tank 110. In some examples, the pump 220*a*, be selectively activated and transport a predetermined amount of the first imaging oil 111 into the segregation tank 110 per activation and/or time period. That is, the pump 220*a* may transport the first imaging oil 111 at the first rate of flow into the segregation tank 110. The flow rate sensor 220*b* may detect the second rate of flow of the first imaging oil 111 out of the segregation tank 110. The replaceable imaging oil supply 228*a* may supply the first imaging oil 111 to the segregation tank 110, as needed. However, the frequency in which the replacement imaging oil supply 228*a* is added may be reduced due to the mixing unit 223 using the respective variable ratio value obtained by the ratio adjustment module 116 to provide at least one of the first and second imaging oil 111 and 113 to the fluid tank 224. The replaceable ink concentrate supply 228*b* may supply the ink concentrate to the fluid tank 224, for example, to be combined with the imaging oil to form ink such as liquid toner, for example, ElectroInk, trademarked by Hewlett-Packard Company, as needed. The ink may be supplied to the fluid applicator unit 230. For example, the fluid applicator unit 230 such as BIDs to apply ink to the photoconductive member 280 to form a respective fluid image thereon.

The image forming system 100 may also include a segregation ratio comparison unit (not illustrated). The segregation ratio comparison unit may determine whether the variable ratio value is at least one of equal to and greater than a threshold ratio value. That is, in some examples, the variable ratio value may be maintained within a segregation range to enable the image forming system 100 to respond to imaging oil changes therein in a reasonable time frame and/or within fewer time intervals.

Figure 3:
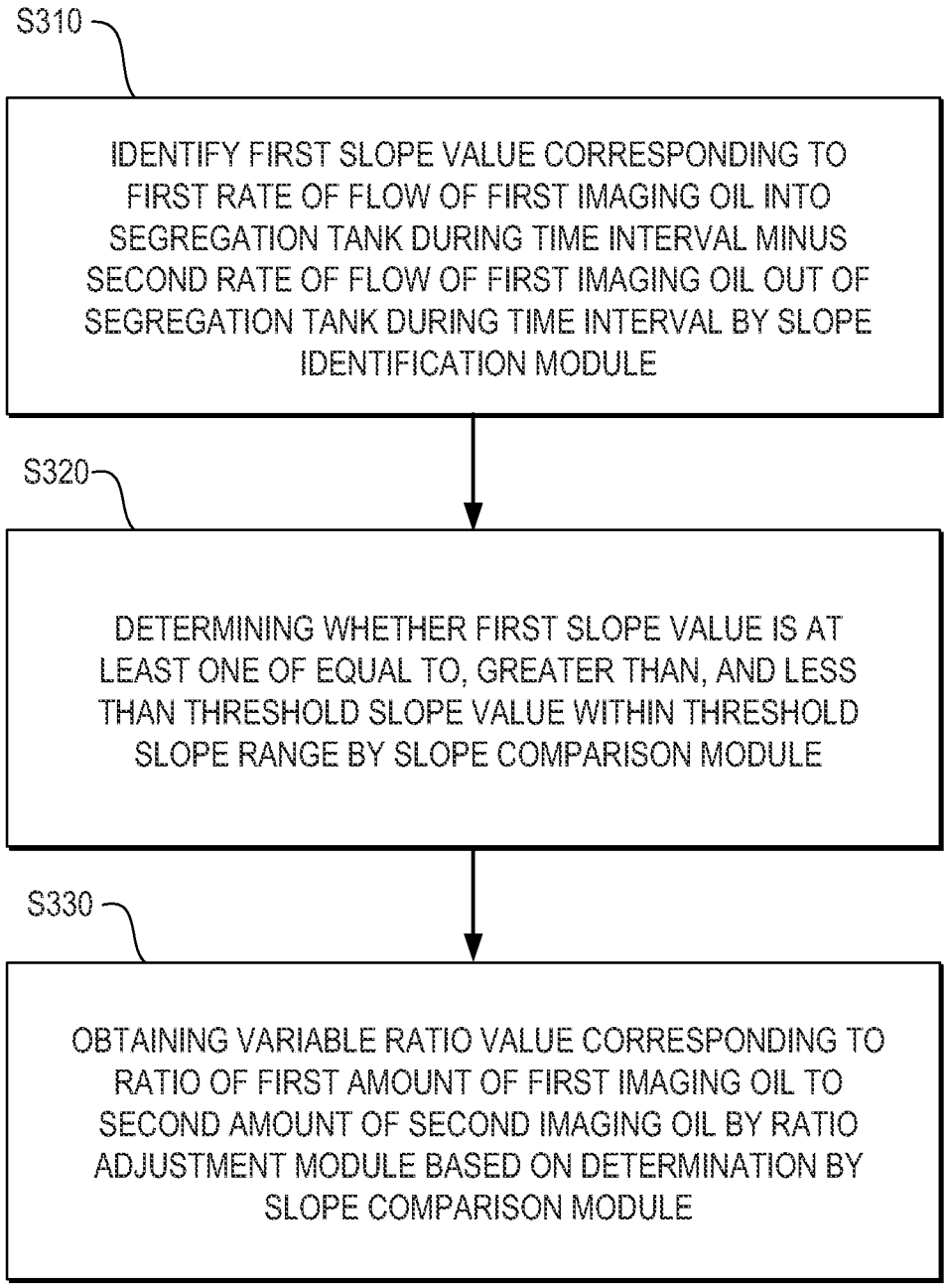
FIG. 3 is a flowchart illustrating a method of determining a variable ratio value of a first imaging oil having a first percent purity in a segregation tank and a second imaging oil having a second percent purity in a reservoir in an image forming system according to an example.

FIG. 3 is a flowchart illustrating a method of determining a respective variable ratio value of a first imaging oil having a first percent purity in a segregation tank and a second imaging oil having a second percent purity in a reservoir in an image forming system according to an example. Referring to FIG. 3, in block S310, a first slope value corresponding to a first rate of flow of the first imaging oil into the segregation tank during a time interval minus a second rate of flow of the first imaging oil out of the segregation tank during the time interval is identified by a slope identification module. The first imaging oil includes the first percent purity. In block S320, whether the first slope value is at least one of equal to, greater than, and less than a threshold slope value within a threshold slope range is determined by a slope comparison module. In block S330, the variable ratio value corresponding to a ratio of a first amount of the first imaging oil to a second amount of the second imaging oil is obtained by a ratio adjustment module based on a determination by the slope comparison module. For example, a previous variable ratio value may be decreased by the ratio adjustment module in response to the first determination obtained by the segregation tank determination module. The second imaging oil includes the second percent purity. In some examples, the second percent purity of the second imaging oil may be less than the first percent purity of the first imaging oil.

The method may also include determining whether a total amount of the first imaging oil in the segregation tank is at least one of equal to and greater than a threshold amount value during the time interval by a segregation tank determination module to obtain one of a first determination and a second determination. For example, a sensor may detect when a level of the first imaging oil corresponding to the total amount of the first imaging oil in the segregation tank corresponds to the threshold amount value. The first determination may correspond to the total amount of the first imaging oil in the segregation tank being at least one of equal to and greater than the threshold amount value during the time interval. The second determination may correspond to the total amount of the first imaging oil in the segregation tank being less than the threshold amount value during the time interval.

The method may also include a second slope value corresponding to the first rate of flow of the first imaging oil into the segregation tank during the time interval minus the second rate of flow of the first imaging oil out of the segregation tank during the time interval that is identified by the slope identification module in response to the second determination obtained by the segregation tank determination module. Additionally, whether the second slope value is at least one of equal to, greater than, and less than the threshold slope value within the threshold slope range may be determined by the slope comparison module in response to the second determination obtained by the segregation tank determination module. Further, the variable ratio value may be obtained by the ratio adjustment module based on the determination by the slope comparison module in response to the second determination obtained by the segregation tank determination module. For example, a previous variable ratio value may be increased, decreased or remain the same to obtain the variable ratio value.

That is, the previous variable ratio value may be decreased by the ratio adjustment module by the slope comparison module to obtain the variable ratio value. The decrease to the previously variable ratio value may be in response to the second determination obtained by the segregation tank determination module and a determination that the second slope value is greater than the threshold slope value within the threshold slope range. Alternatively, the previous variable ratio value may be increased by the ratio adjustment module in response to the second determination obtained by the segregation tank determination module and a determination that the second slope value is less than the threshold slope value within the threshold slope range by the slope comparison module. Still yet, the previous variable ratio value may be used as the variable ratio value in response to the second determination obtained by the segregation tank determination module and a determination that the second slope value is equal to the threshold slope value within the threshold slope range by the slope comparison module. That is, the newly obtained variable ratio value may be equal to the previously obtained variable ratio value.

The method may also include adding at least one of the first imaging oil and the second imaging oil to the fluid tank by a mixing unit corresponding to the respective variable ratio value in response to a decrease in an amount of at least one of the first imaging oil and the second imaging oil in a fluid tank. That is, the decrease in the respective amount of the respective imaging oil in the fluid tank may be due to printing demands of the image forming system including an amount of printing and the type of images printed. The method may also include periodically determining the respective variable ratio values at predetermined time periods. That is, the method may be continually repeated, for example, to periodically determine respective various ratio values that correspond to current conditions in real-time.

Figure 4:
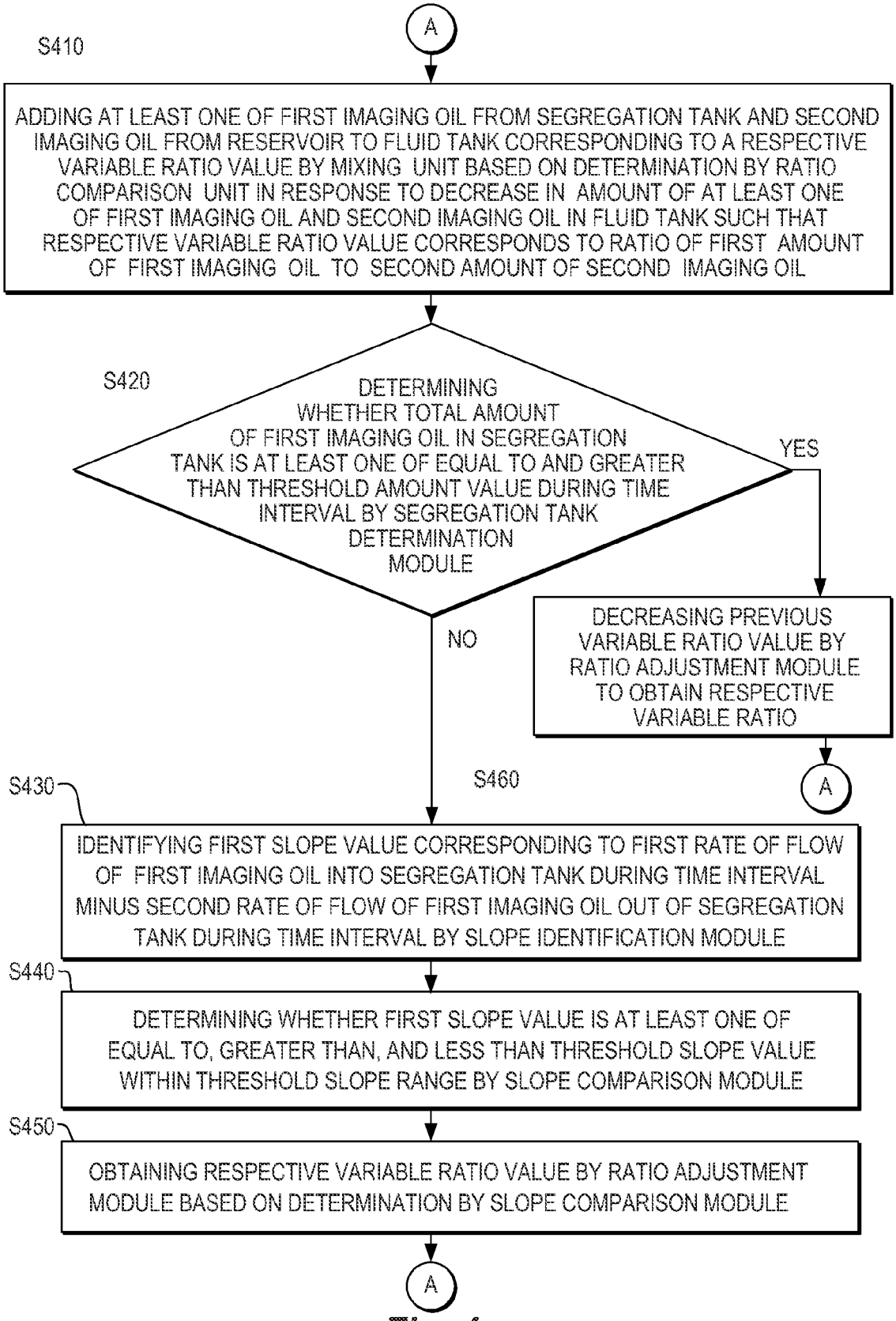
FIG. 4 is a flowchart illustrating a method of adding a first imaging oil having a first percent purity and a second imaging oil having a second percent purity less than the first percent purity corresponding to a respective variable ratio value to a fluid tank of an image forming system according to an example.

FIG. 4 is a flowchart illustrating a method of adding a first imaging oil having a first percent purity and a second imaging oil having a second percent purity less than the first percent purity corresponding to a respective variable ratio value to a fluid tank of an image forming system according to an example. Referring to FIG. 4, in block S410, at least one of the first imaging oil from a segregation tank and the second imaging oil from a reservoir is added to the fluid tank corresponding to a respective variable ratio value by a mixing unit based on a determination by a ratio comparison unit. The addition of the respective imaging oils 111 and 113 is in response to a decrease in an amount of at least one of the first imaging oil and the second imaging oil in the fluid tank. The decrease in the respective amount of imaging oil may be due to printing demands of the image forming system including an amount of printing and the type of images printed. The respective variable ratio value corresponds to a ratio of the first amount of first imaging oil to the second amount of the second imaging oil.

In block S420, whether a total amount of the first imaging oil in the segregation tank is at least one of equal to and greater than a threshold amount value during a time interval is determined by a segregation tank determination module. If the determination of block S420 is yes, in block S460, the respective variable ratio is obtained by the ratio adjustment module by decreasing a previous variable ratio value by the ratio adjustment module. Further, the operation may continue by proceeding to block S410.

Alternatively, if the determination of block S420 is no, the respective variable ratio is obtained by operations S430 through S450. That is, in block S430, a first slope value corresponding to a first rate of flow of the first imaging oil into the segregation tank during the time interval minus a second rate of flow of the first imaging oil out of the segregation tank during the time interval is determined by a slope identification module. In block S440, whether the first slope value is at least one of equal to, greater than, and less than a threshold slope value within a threshold slope range is determined by a slope comparison module. In block S450, the respective variable ratio value corresponding to a ratio of the first amount of the first imaging oil to the second amount of the second imaging oil is obtained by a ratio adjustment module based on a determination by the slope comparison module. Further, the operation may continue by proceeding to block S410.

It is to be understood that the flowcharts of FIGS. 3 and 4 illustrate an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 3 and 4 illustrate a specific order of execution, the order of execution may differ from that which is depicted. For example, the order of execution of two or more blocks may be scrambled relative to the order illustrated. Also, two or more blocks illustrated in succession in FIGS. 3 and 4 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method of determining a variable ratio value of a first imaging oil having a first percent purity in a segregation tank and a second imaging oil having a second percent purity in a reservoir in an image forming system, the method comprising:

identifying a first slope value corresponding to a first rate of flow of the first imaging oil into the segregation tank during a time interval minus a second rate of flow of the first imaging oil out of the segregation tank during the time interval by a slope identification module;

identifying a second amount of a second imaging oil;

determining whether the first slope value is equal to, greater than, or less than a threshold slope value within a threshold slope range by a slope comparison module; and obtaining the variable ratio value corresponding to a ratio of a first amount of the first imaging oil to the second amount of the second imaging oil by a ratio adjustment module based on a determination by the slope comparison module.

2. The method according to claim 1, further comprising:

determining whether a total amount of the first imaging oil in the segregation tank is at least one of equal to or greater than a threshold amount value during the time, interval by a segregation tank determination module to obtain one of a first determination and a second determination.

3. The method according to claim 2, wherein the determining whether the total amount of the first imaging oil in the segregation tank is at least one of equal to or greater than a threshold amount value during the time interval by the segregation tank determination module further comprises:

detecting when a level of the first imaging oil corresponding to the total amount of the first imaging oil in the segregation tank corresponds to the threshold amount value by a sensor.

4. The method according to claim 2, further comprising:

identifying a second slope value corresponding to the first rate of flow of the first imaging oil into the segregation tank during the time interval minus the second rate of flow of the first imaging oil out of the segregation tank during the time interval by the slope identification module in response to the second determination obtained by the segregation tank determination module;

determining whether the second slope value is equal to, greater than, or less than the threshold slope value within the threshold slope range by the slope comparison module in response to the second determination obtained by the segregation tank determination module; and obtaining the variable ratio value by the ratio adjustment module based on the determination by the slope comparison module in response to the second determination obtained by the segregation tank determination module.

5. The method according to claim 4, wherein the obtaining the variable ratio value by the ratio adjustment module based on the determination by the slope comparison module in response to the second determination obtained by the segregation tank determination module further comprises at least one of:

decreasing a previous variable ratio value by the ratio adjustment module in response to the second determination obtained by the segregation tank determination module and a determination that the second slope value is greater than the threshold slope value within the threshold slope range by the slope comparison module;

increasing the previous variable ratio value by the ratio adjustment module in response to the second determination obtained by the segregation tank determination module and a determination that the second slope value is less than the threshold slope value within the threshold slope range by the slope comparison module; and using the previous variable ratio value as the variable ratio value in response to the second determination obtained by the segregation tank determination module and a determination that the second slope value is equal to the threshold slope value within the threshold slope range by the slope comparison module.

6. The method according to claim 4, wherein the second determination corresponds to the total amount of the first imaging oil in the segregation tank being less than the threshold amount value during the time interval.

7. The method according to claim 1, wherein the second percent purity of the second imaging oil is less than the first percent purity of the first imaging oil.

8. The method according to claim 7, wherein the obtaining the variable ratio value further comprises:

decreasing a previous variable ratio value by the ratio adjustment module in response to the first determination obtained by the segregation tank determination module.

9. The method according to claim 8, wherein the first determination corresponds to the total amount of the first imaging oil in the segregation tank being at least one of equal to or greater than the threshold amount value during the time interval.

10. The method according to claim 1, further comprising:

periodically determining the variable ratio value at predetermined time periods.

11. The method according to claim 1, further comprising:

adding at least one of the first imaging oil and the second imaging oil to the fluid tank corresponding to the respective variable ratio value in response to a decrease in an amount of at least one of the first imaging oil and the second imaging oil in a fluid tank.

12. An image forming system, comprising:

a segregation tank to store a first imaging oil having a first percent purity;

a reservoir to store a second imaging oil having a second percent purity less than the first percent purity;

a slope identification module to identify a first slope value corresponding to a first rate of flow of the first imaging oil into the segregation tank during a time interval minus, a second rate of flow of the first imaging oil out of the segregation tank during the time interval;

a slope comparison module to determine whether the first slope value is equal to, greater than, or less than a threshold slope value within a threshold slope range; and a ratio adjustment module to obtain a variable ratio value corresponding to a ratio of a first amount of the first imaging oil to an identified second amount of the second imaging oil based on a determination by the slope comparison module.

13. The image forming system according to claim 12, further comprising:

a segregation tank determination module to determine whether a total amount of the first imaging oil in the segregation tank is at least one of equal to or greater than a threshold amount value d ring the time interval to obtain one of a first determination and a second determination.

14. The image forming system according to claim 13, wherein the segregation tank determination module further comprises:

a sensor to detect when a level of the first imaging oil in the segregation tank corresponding to the total amount of the first imaging oil in the segregation tank corresponds to the threshold amount value.

15. The image forming system according to claim 13, wherein the ratio adjustment module obtains the variable ratio value by decreasing a previous variable ratio value in response to the first determination obtained by the segregation tank determination module such that the first determination corresponds to the total amount of the first imaging oil in the segregation tank that is at least one of equal to or greater than the threshold amount value during the time interval.

16. The image forming system according to claim 13, wherein:

the slope identification module identifies a second slope value corresponding to the first rate of flow of the first imaging oil into the segregation tank during the time interval minus the second rate of flow of the first imaging oil out of the segregation tank during the time interval in response to the second determination obtained by the segregation tank determination module;

the slope comparison module determines whether the second slope value is equal to, greater than, or less than the threshold slope value within the threshold slope range in response to the second determination obtained by the segregation tank determination module; and the ratio adjustment module obtains the variable ratio value based on the determination by the slope comparison module in response to the second determination obtained by the segregation tank determination module.

17. The image forming system according to claim 16, wherein at least one of:

the ratio adjustment module decreases a previous variable ratio value in response to the second determination obtained by the segregation tank determination module and a determination that the second slope value is greater than the threshold slope value within the threshold slope range by the slope comparison module;

the ratio adjustment module increases the previous variable ratio value in response to the second determination obtained by the segregation tank determination module and a determination that the second slope value is less than the threshold slope value within the threshold slope range by the slope comparison module; and the variable ratio value remains the same as the previous variable ratio value in response to the second determination obtained by the segregation tank determination module and a determination that the second slope value is equal to the threshold slope value within the threshold slope range by the slope comparison module.

18. The image forming system according to claim 13, wherein the second determination corresponds to the total amount of the first imaging oil in the segregation tank being less than the threshold amount value during the time interval.

19. The image forming system according to claim 13, further comprising:

a mixing unit to add at least one of the first imaging oil from the segregation tank and the second imaging oil from the reservoir to a fluid tank corresponding to the respective variable ratio value based on a determination by the ratio comparison unit and in response to a decrease in an amount of at least one of the first imaging oil and the second imaging oil in the fluid tank.

20. A method of adding a first imaging oil having a first percent purity and a second imaging oil having a second percent purity less than the first percent purity corresponding to a respective variable ratio value to a fluid tank of an image forming system, the method comprising:

identifying an amount of the second amount of a second imaging oil:

adding at least one of the first imaging oil from a segregation tank and the second imaging oil from a reservoir to the fluid tank corresponding to a respective variable ratio value by a mixing unit based on a determination by a ratio comparison unit in response to a decrease in an amount of at least one of the first imaging oil and the second imaging oil in the fluid tank such that the respective variable ratio value corresponds to a ratio of the first amount of first imaging oil to the second amount of the second imaging oil; and determining whether a total amount of the first imaging oil in the segregation tank is at least one of equal to or greater than a threshold amount value during a time interval by a segregation tank determination module such that:

if not, obtaining the respective variable ratio by the ratio adjustment module includes:

identifying a first slope value corresponding to a first rate of flow of the first imaging oil into the segregation tank during the time interval minus a second rate of flow of the first imaging oil out of the segregation tank during the time interval by a slope identification module;

determining whether the first slope value is at least one of equal to, greater than, and less than a threshold slope value within a threshold slope range by a slope comparison module; and obtaining the respective variable ratio value corresponding to a ratio of the first amount of the first imaging oil to the second amount of the second imaging oil by a ratio adjustment module based on a determination by the slope comparison module; and if so, the obtaining the respective variable ratio by the ratio adjustment module includes:

decreasing a previous variable ratio value by the ratio adjustment module.

* * * * *

UNITED STATES PATENT AND TRADEMARK OFFICE

CERTIFICATE OF CORRECTION

PATENT NO. : 8,774,661 B2
APPLICATION NO. : 13/285497
DATED : July 8, 2014
INVENTOR(S) : Assaf Pines et al.

It is certified that error appears in the above-identified patent and that said Letters Patent is hereby corrected as shown below:

In the claims

In column 9, line 29, in Claim 2, delete "time," and insert -- time --, therefor.

In column 10, line 50, in Claim 12, delete "minus," and insert -- minus --, therefor.

In column 10, line 65, in Claim 13, delete "d ring" and insert -- during --, therefor.

In column 12, line 18, in Claim 20, delete "oil:" and insert -- oil; --, therefor.

Signed and Sealed this
Fourteenth Day of June, 2016

Michelle K. Lee

Michelle K. Lee
*Director of the United States Patent and Trademark Office*